US012376708B1

(12) United States Patent
Liu et al.

(10) Patent No.: US 12,376,708 B1
(45) Date of Patent: Aug. 5, 2025

(54) BABY BATH SUPPORT DEVICE

(71) Applicant: Shenzhen Wenjian Technology Co., Ltd., Shenzhen (CN)

(72) Inventors: Zhi Liu, Shenzhen (CN); Tingting Yin, Shenzhen (CN)

(73) Assignee: Shenzhen Wenjian Technology Co. , Ltd., Shenzhen (CN)

( * ) Notice: Subject to any disclaimer, the term of this patent is extended or adjusted under 35 U.S.C. 154(b) by 0 days.

(21) Appl. No.: 19/075,472

(22) Filed: Mar. 10, 2025

(30) Foreign Application Priority Data

Jan. 26, 2025 (CN) ..... 202520175239.6

(51) Int. Cl.
*A47K 3/12* (2006.01)

(52) U.S. Cl.
CPC ..... *A47K 3/127* (2013.01)

(58) Field of Classification Search
CPC ..... A47K 3/127; A47K 3/034; A47K 3/03
USPC ..... 4/572.1
See application file for complete search history.

(56) References Cited

U.S. PATENT DOCUMENTS

| | | | | |
|---|---|---|---|---|
| 2,222,070 | A * | 11/1940 | Graves | A47K 3/001 248/168 |
| 2,285,900 | A * | 6/1942 | Chapman | A47K 3/127 297/229 |
| 2,807,028 | A * | 9/1957 | Cavanaugh | A47K 3/034 D32/57 |
| 4,295,683 | A * | 10/1981 | Dubbink | A47K 3/122 4/575.1 |
| 7,065,805 | B1 * | 6/2006 | Sundberg | A47K 3/127 5/103 |
| 7,533,425 | B2 * | 5/2009 | Monti | A47K 3/024 4/628 |
| 11,627,842 | B2 | 4/2023 | Bethmann et al. | |
| 11,633,070 | B2 | 4/2023 | Morand | |

* cited by examiner

*Primary Examiner* — Huyen D Le

(57) ABSTRACT

A baby bath support device includes: a first frame, a second frame, and a support member connected to the first frame and the second frame. The support member is to provide support for a child during bathing. The support member is made of a flexible material, the first frame and the second frame are made of a hard material, and the support member is to allow the baby bath support device to be foldable between a supporting state and a folding state.

12 Claims, 4 Drawing Sheets

BABY BATH SUPPORT DEVICE

CROSS REFERENCE TO RELATED APPLICATIONS

This application claims priority to Chinese Patent Application No. CN 202520175239.6, filed Jan. 26, 2025, which is hereby incorporated by reference herein as if set forth in its entirety.

TECHNICAL FIELD

The present disclosure generally relates to baby bath support devices, and in particular relates to a foldable baby bath support device.

BACKGROUND

A baby bath support device is usually used to support a baby during bathing. It is usually made of a rigid material and has an inclined surface to support a baby lying on his back. The baby lies on the inclined surface, which may have some anti-slip material. Although the conventional baby bath support devices can meet basic needs, it is useful and necessary to provide a new, especially foldable baby bath support device.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
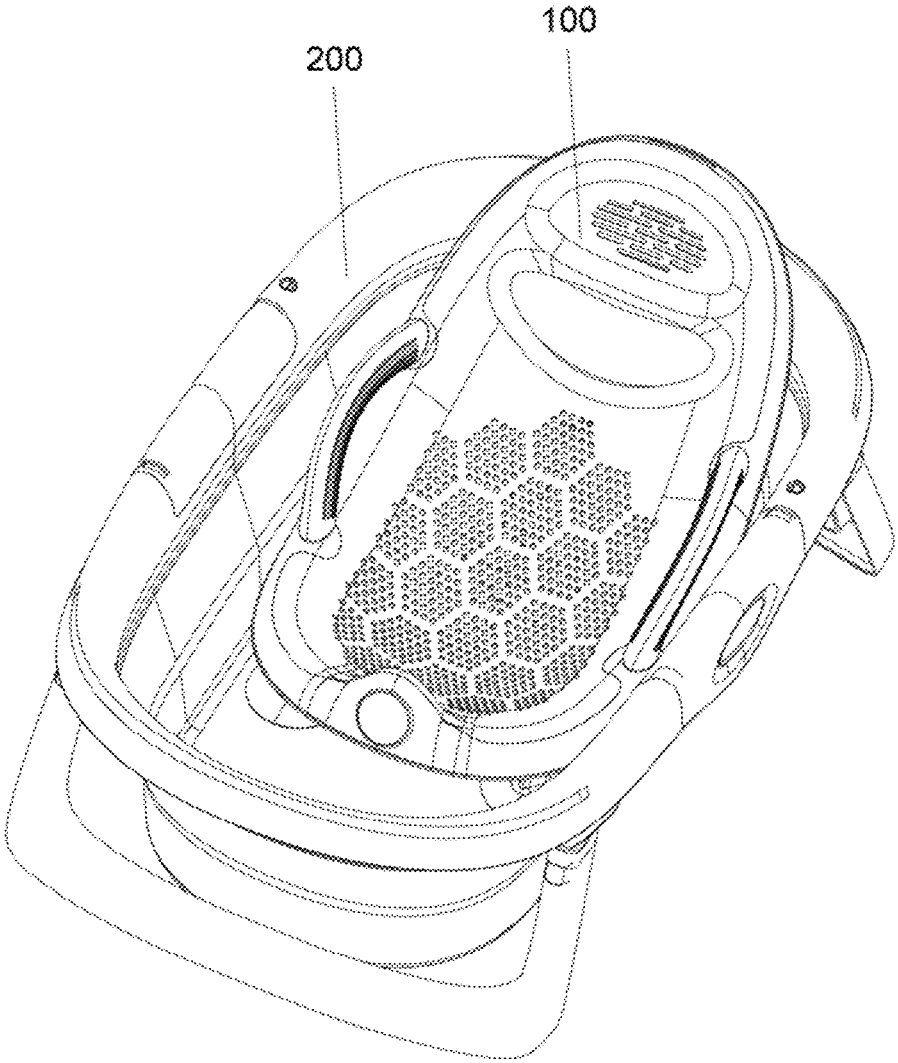
FIG. 1 is a schematic isometric view of a baby bath support device according to one embodiment, which is placed in a bathtub.
Figure 2:
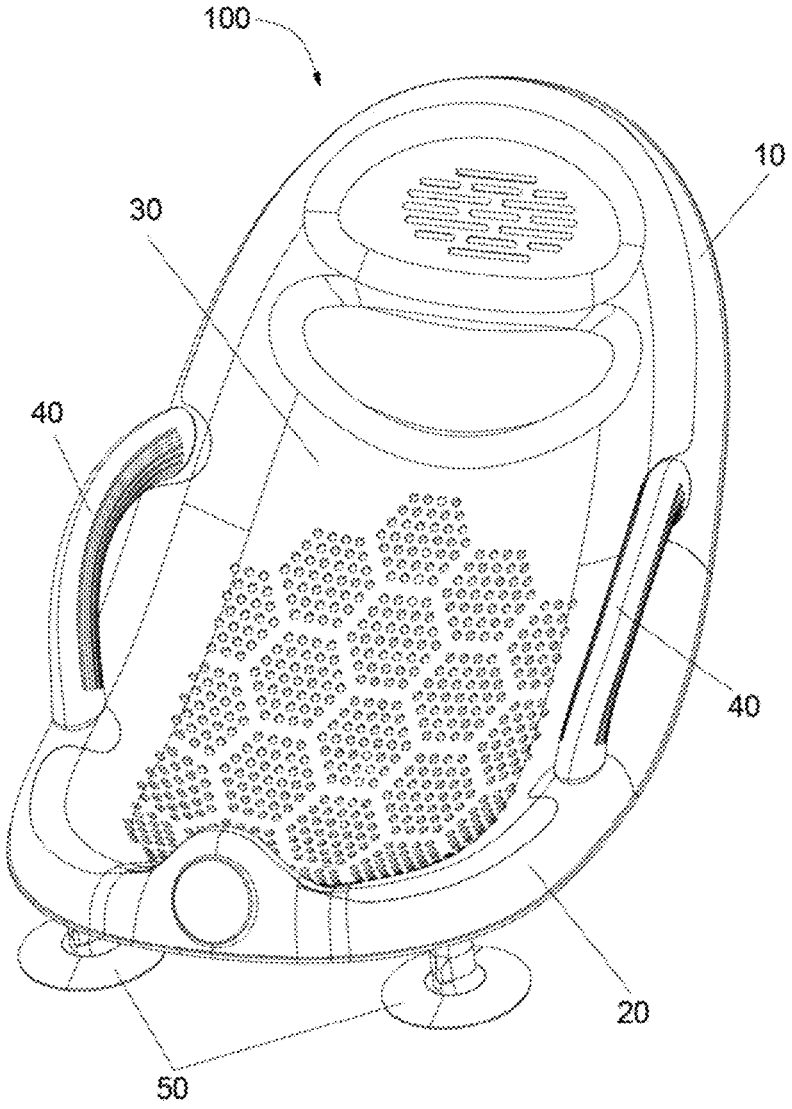
FIG. 2 is a schematic isometric view of the baby bath support device according to one embodiment.
Figure 3:
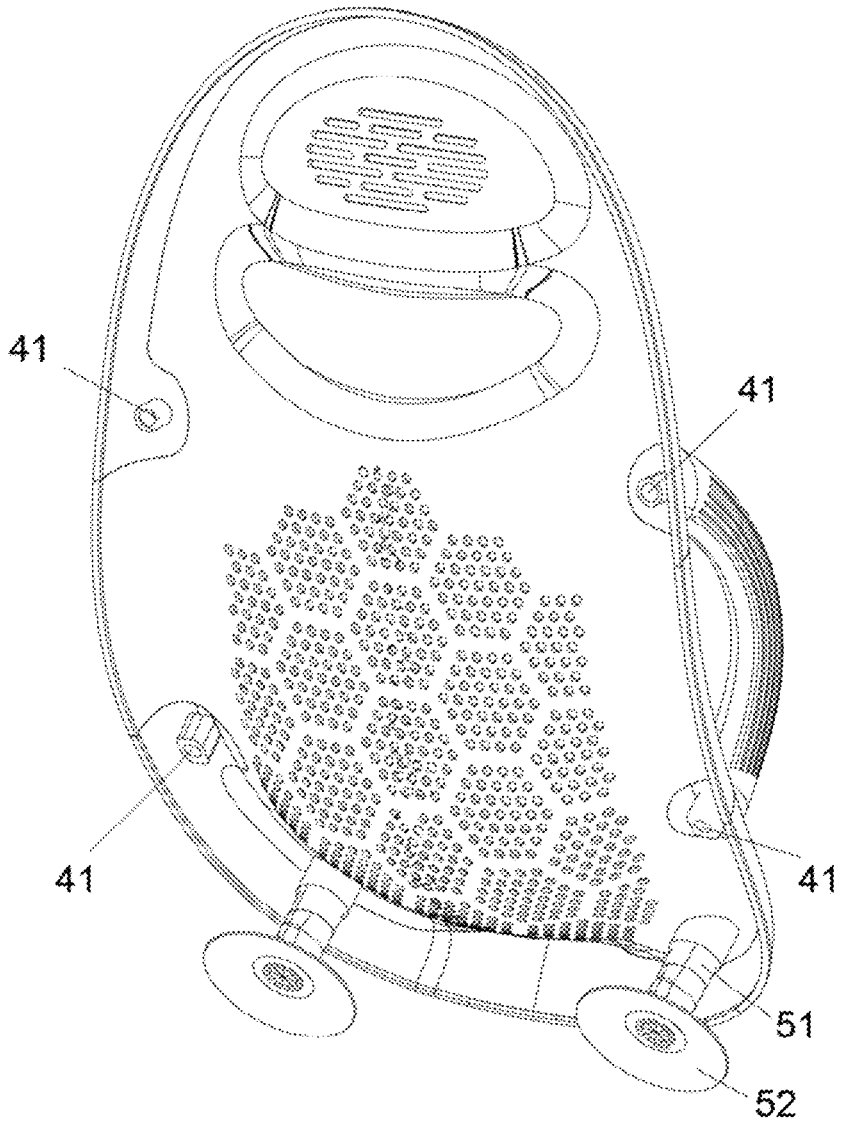
FIG. 3 is another schematic isometric view of the baby bath support device viewed from a different perspective.
Figure 4:
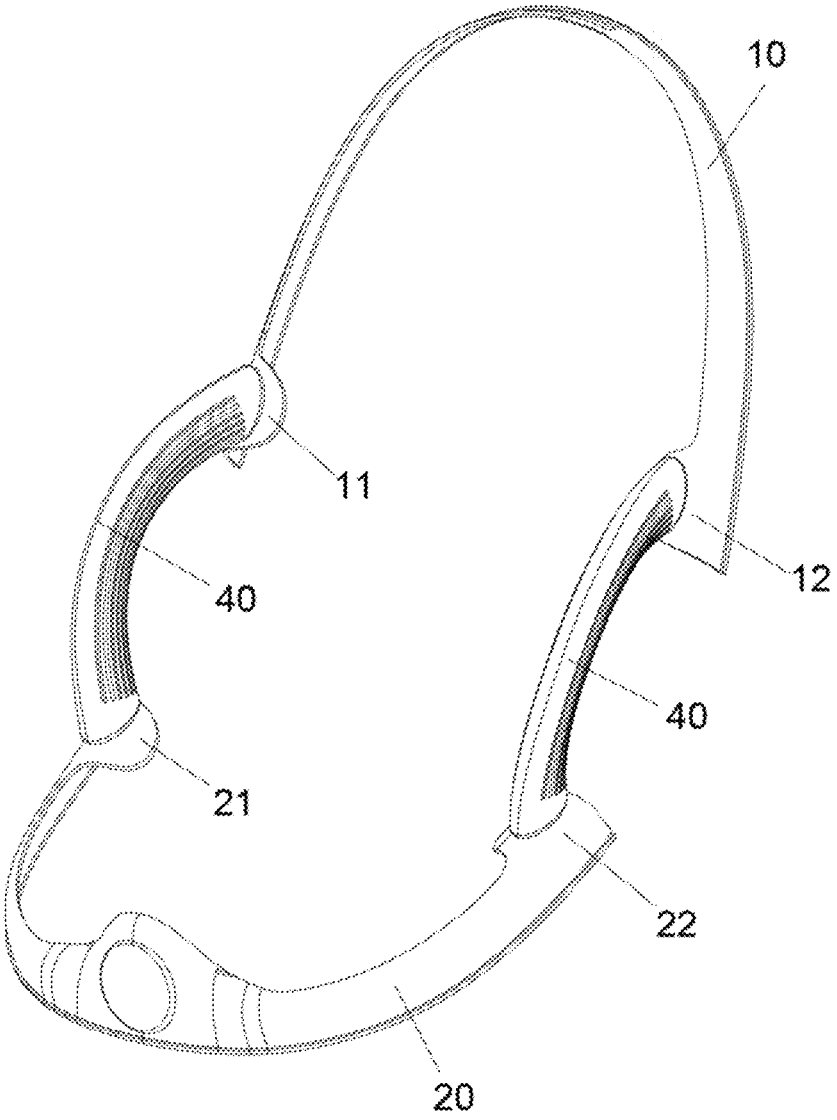
FIG. 4 is another schematic isometric view of the baby bath support device viewed from a different perspective with a support member omitted.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Referring to FIGS. 1-4, in one embodiment, a baby bath support device 100 includes a first frame 10, a second frame 20, and a support member 30 connected to the first frame 10 and the second frame 20. The support member 30 is to provide support for a baby during bathing. The support member 30 is made of a flexible material, and the first frame 10 and the second frame 20 are made of a hard material, and the support member 30 is to allow the bath support device 100 to be foldable between a supporting state (as shown in FIG. 1) and a folded state. For example, there is a preset distance between the opposite ends of the first frame 10 and the second frame 20 to allow the support portion 30 to be foldable between the supporting state and the folded state.

With the above configuration, since the support member 30 is made of a flexible material and there is a preset distance between the opposite ends of the first frame 10 and the second frame 20, the baby bath support device 100 can be folded, thereby requiring less storage space.

In one embodiment, the support member 30 is a piece of thin flexible plastic that can be elastically deformed. In this way, the support member 30 can withstand a predetermined number of repeated foldings without being damaged. The first frame 10 and the second frame 20 are made of hard plastic. In one embodiment, the first frame 10, the second frame 20 and the support portion 30 are integrally formed, for example, by double-shot injection molding.

In one embodiment, in the supporting state as shown in FIG. 1, the support member 30 is in the shape of a curved sheet, allowing it to provide sufficient space for a baby to lie on their back.

In one embodiment, the first frame 10 and the second frame 20 are both arc-shaped. In the perspective shown in FIG. 2, the first frame 10 surrounds the top edge of the support member 30, and the second frame 20 surrounds the bottom edge of the support member 30. In the embodiment shown in FIG. 2, the first portion of the support member 30 surrounded by the first frame 10 accounts for approximately ⅓ of the total area of the support member 30, the second portion of the support portion 30 surrounded by the second frame 20 accounts for approximately ⅓ of the total area of the support member 30, and the third portion located between the first portion and the second portion accounts for approximately ⅓ of the total area of the support member 30. With such a structure, there is a sufficient distance between the opposite ends of the first frame 10 and the second frame 20, so that the third portion can be freely bent without being restricted by the hard first frame 10 and the second frame 20, allowing the baby bath support device 100 to be foldable. In the folded state, the first portion can be in contact with or close to being in contact with the second portion. It should be noted that the preset distance between the opposing ends of the aforementioned first frame 10 and second frame 20 is set to ensure that the baby bath support device 100 can fold without being restricted by the rigid first frame 10 and second frame 20. This distance can be determined based on the actual shape and size of the first frame 10 and second frame 20. It can be understood that in one embodiment, the opposite ends of the first frame 10 and the second frame 20 can be very close to each other, or even contact each other. At this time, the support portion 30 only includes the above-mentioned first portion and the second portion.

In one embodiment, the baby bath support device 100 further includes two grab bars 40. The first frame 10 includes a first end 11 and a second end 12. The second frame 20 includes a third end 21 and a fourth end 22. The first end 11 and the third end 21 are opposite to each other, the second end 12 and the fourth end 22 are opposite to each other. The opposite ends of one of the two grab bars 40 are detachably connected to the first end 11 and the third end 21, respectively, and the opposite ends of the other of the two grab bars 40 are detachably connected to the second end 12 and the fourth end 22, respectively.

A baby can grasp the two grab bars 40, so that force can be applied to the two grab bars 40 to adjust his/her posture. After the two grab bars 40 are connected to the first frame 10 and the second frame 20, they form a rigid closed body, which provides sufficient rigidity for the entire baby bath support device 100. In the state shown in FIG. 1, the first frame 10 rests against the edge of a bathtub 200. Due to the rigidity provided by the rigid closed body, after the baby lies on the support member 30, the support member 30 can still maintain the state shown in FIG. 1 without collapse or deformation.

In one embodiment, opposite ends of each grab bar 40 are protruded with a post 41. The first frame 10 defines two through holes in the first end 11 and the second end 12, and the second frame 20 defines two through holes in the third end 21 and the fourth end 22. The posts 41 of the two grab bars 40 are respectively inserted into the through holes in the first end 11 and the second end 12 of the first frame 10 and the through holes at the third end 21 and the fourth end 22 of the second frame 20. It can be understood that the two grab bars 40 can be detachably connected to the first frame 10 and the second frame 20 by other known connection methods as needed, which will not be repeated here.

In one embodiment, the baby bath support device 100 further includes a connecting mechanism 50 connected to the first frame 10 or the second frame 20 and connectable to the bathtub 200. After the connecting mechanism 50 is connected to the bathtub 200, the baby bath support device 100 is less likely to move. In one embodiment, the connecting mechanism 50 includes two support posts 51 protruding from the back side of the first frame 10 or the second frame 20 and two suction cups 52 connected to the support posts 51. The suction cups 52 can be firmly attached to the bottom of the bathtub 200 through vacuum negative pressure. In the state shown in FIG. 1, the first frame 10 of the baby bath support device 100 is against the edge of the bathtub, and the suction cups 52 of the two connecting mechanism 50 are tightly attached to the bottom of the bathtub 200. In this way, the baby bath support device 100 will not move easily, preventing obstruction or danger to the baby during bathing. It can be understood that the connecting mechanism 50 can adopt other known connection structures as needed, which will not be repeated here.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A baby bath support device comprising:

a first frame;

a second frame; and a support member connected to the first frame and the second frame, the support member configured to provide support for a child during bathing;

wherein the support member is made of a flexible material, the first frame and the second frame are made of a hard material, and the support member is configured to allow the baby bath support device to be foldable between a supporting state and a folding state;

wherein the first frame, the second frame and the support member are integrally formed.

2. The baby bath support device of claim 1, wherein the first frame and the second frame are both arc-shaped.

3. The baby bath support device of claim 2, further comprising two grab bars, wherein the first frame comprises a first end and a second end, the second frame comprises a third end and a fourth end, the first end and the third end are opposite to each other, the second end and the fourth end are opposite to each other, opposite ends of a first of the two grab bars are respectively detachably connected to the first end and the third end, and opposite ends of a second of the two grab bars are respectively detachably connected to the second end and the fourth end.

4. The baby bath support device of claim 3, wherein opposite ends of each of the two grab bars are protruded with posts, the first frame defines two through holes at the first end and the second end, the second frame two through holes at the third end and the fourth end, and the posts of the two grab bars are respectively inserted into the through holes at the first end and the second end of the first frame and the through holes at the third end and the fourth end of the second frame.

5. The baby bath support device of claim 1, further comprising a connecting mechanism connected to the first frame or the second frame, wherein the connecting mechanism is detachably connectable to a bathtub.

6. The baby bath support device of claim 5, wherein the connecting mechanism comprises two posts protruding from a back side of the first frame or the second frame and two suction cups connected to the two posts respectively.

7. A baby bath support device comprising:

a first frame;

a second frame; and a support member connected to the first frame and the second frame, the support member configured to provide support for a child during bathing;

wherein the support member is made of a flexible material, the first frame and the second frame are made of a hard material, and the support member comprises a first portion surrounded by the first frame and a second portion surrounded by the second frame;

wherein the first frame and the second frame are both arc-shaped.

8. The baby bath support device of claim 7, wherein the first frame, the second frame and the support member are integrally formed.

9. The baby bath support device of claim 7, further comprising two grab bars, wherein the first frame comprises a first end and a second end, the second frame comprises a third end and a fourth end, the first end and the third end are opposite to each other, the second end and the fourth end are opposite to each other, opposite ends of a first of the two grab bars are respectively detachably connected to the first end and the third end, and opposite ends of a second of the two grab bars are respectively detachably connected to the second end and the fourth end.

10. The baby bath support device of claim 9, wherein opposite ends of each of the two grab bars are protruded with posts, the first frame defines two through holes at the first end and the second end, the second frame two through holes at the third end and the fourth end, and the posts of the two grab bars are respectively inserted into the through holes at the first end and the second end of the first frame and the through holes at the third end and the fourth end of the second frame.

11. The baby bath support device of claim 7, further comprising a connecting mechanism connected to the first frame or the second frame, wherein the connecting mechanism is detachably connectable to a bathtub.

12. The baby bath support device of claim 11, wherein the connecting mechanism comprises two posts protruding from a back side of the first frame or the second frame and two suction cups connected to the two posts respectively.

* * * * *